US010891962B2

(12) United States Patent
Peichl et al.

(10) Patent No.: US 10,891,962 B2
(45) Date of Patent: Jan. 12, 2021

(54) INTEGRATED RECONSTRUCTION AND RENDERING OF AUDIO SIGNALS

(71) Applicant: DOLBY INTERNATIONAL AB, Amsterdam Zuidoost (NL)

(72) Inventors: Klaus Peichl, Fürth (DE); Tobias Friedrich, Fürth (DE); Robin Thesing, Nuremberg (DE); Heiko Purnhagen, Sundbyberg (SE); Martin Wolters, Nuremberg (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 16/486,493

(22) PCT Filed: Mar. 6, 2018

(86) PCT No.: PCT/EP2018/055462

§ 371 (c)(1),
(2) Date: Aug. 15, 2019

(87) PCT Pub. No.: WO2018/162472

PCT Pub. Date: Sep. 13, 2018

(65) Prior Publication Data

US 2020/0005801 A1 Jan. 2, 2020

Related U.S. Application Data

(60) Provisional application No. 62/467,445, filed on Mar. 6, 2017.

(30) Foreign Application Priority Data

Mar. 6, 2017 (EP) ..... 17159391

(51) Int. Cl.
*G10L 19/008* (2013.01)
*H04S 3/00* (2006.01)
*H04S 7/00* (2006.01)

(52) U.S. Cl.
CPC ..... *G10L 19/008* (2013.01); *H04S 3/008* (2013.01); *H04S 7/30* (2013.01); *H04S 2400/03* (2013.01); *H04S 2420/03* (2013.01)

(58) Field of Classification Search
USPC ..... 381/20, 22, 23, 58, 71.9
See application file for complete search history.

(56) References Cited

U.S. PATENT DOCUMENTS

2010/0094631 A1 4/2010 Engdegard
2015/0142453 A1 5/2015 Oomen
(Continued)

FOREIGN PATENT DOCUMENTS

WO 2008131903 A1 11/2008
WO 2014053547 A1 4/2014
(Continued)

OTHER PUBLICATIONS

Engdegard, J. et al "Spatial Audio Object Coding (SAOC)—The Upcoming MPEG Standard on Parametric Object Based Audio Coding" presented at the 124th Convention, May 17-20, 2008, Amsterdam, The Netherlands, pp. 1-15.
(Continued)

*Primary Examiner* — Yosef K Laekemariam

(57) ABSTRACT

A method for rendering an audio output based on an audio data stream including M audio signals, side information including a series of reconstruction instances of a reconstruction matrix C and first timing data, the side information allowing reconstruction of N audio objects from the M audio signals, and object metadata defining spatial relationships between the N audio objects. The method includes gener-
(Continued)

ating a synchronized rendering matrix based on the object metadata, the first timing data, and information relating to a current playback system configuration, the synchronized rendering matrix having a rendering instance for each reconstruction instance, multiplying each reconstruction instance with a corresponding rendering instance to form a corresponding instance of an integrated rendering matrix, and applying the integrated rendering matrix to the audio signals in order to render an audio output.

14 Claims, 8 Drawing Sheets

(56) References Cited

U.S. PATENT DOCUMENTS

| | | | |
|---|---|---|---|
| 2015/0154965 | A1 | 6/2015 | Wuebbolt |
| 2016/0104496 | A1 | 4/2016 | Purnhagen |
| 2016/0125887 | A1 | 5/2016 | Purnhagen |
| 2016/0241981 | A1 | 8/2016 | Law |

FOREIGN PATENT DOCUMENTS

| | | | | | |
|---|---|---|---|---|---|
| WO | 2014187990 | A1 | | 11/2014 | |
| WO | 2014187991 | A1 | | 11/2014 | |
| WO | 2015011015 | A1 | | 1/2015 | |
| WO | 2015150384 | A1 | | 10/2015 | |
| WO | 2016018787 | A1 | | 2/2016 | |
| WO | WO 2014/187991 | | * | 5/2016 | ..... G10L 19/008 |
| WO | 2016130500 | A1 | | 8/2016 | |

OTHER PUBLICATIONS

Falch, C. et al "Spatial Audio Object Coding with Enhanced Audio Object Separation" Proc. of the 13th International Conference on Digital Audio Effects (DAFx-10), Graz, Austria, Sep. 6-10, 2010.

* cited by examiner

INTEGRATED RECONSTRUCTION AND RENDERING OF AUDIO SIGNALS

CROSS-REFERENCE TO RELATED APPLICATIONS

This application claims priority of the following priority applications: US provisional application 62/467,445, filed 6 Mar. 2017 and EP application 17159391.6, filed 6 Mar. 2017, which are hereby incorporated by reference.

FIELD OF THE INVENTION

The present invention generally relates to coding of an audio scene comprising audio objects. In particular, it relates to a decoder and associated methods for decoding and rendering a set of audio signals to form an audio output.

BACKGROUND OF THE INVENTION

An audio scene may generally comprise audio objects and audio channels. An audio object is an audio signal which has an associated spatial position which may vary with time. An audio channel is (conventionally) an audio signal which corresponds directly to a channel of a multichannel speaker configuration, such as a classical stereo configuration with a left and a right speaker, or a so-called 5.1 speaker configuration with three front speakers, two surround speakers, and a low frequency effects speaker.

Since the number of audio objects typically may be very large, for instance in the order of tens or hundreds of audio objects, there is a need for encoding methods which allow the audio objects to be efficiently compressed at an encoder side, e.g. for transmission as a data stream, and then reconstructed at a decoder side.

One prior art example is to combine the audio objects into a multichannel downmix comprising a plurality of audio channels that correspond to the channels of a certain multichannel speaker configuration (such as a 5.1 configuration) on an encoder side, and to reconstruct the audio objects parametrically from the multichannel downmix on a decoder side.

A generalization of this approach is disclosed for example in WO2014187991 and WO2015150384, where the multichannel downmix is not associated with a particular playback system, but rather is adaptively selected. According to this approach, the N audio objects are downmixed on the encoder side to form M downmix audio signals (M<N). The coded data stream includes these downmix audio signals and side information which enables reconstruction of the N audio objects on the decoder side. The data stream further includes object metadata describing the spatial relationship between objects, which allows rendering of the N audio objects to form an audio output.

Documents WO2014187991 and WO2015150384 mention that the reconstruction and rendering operations may be combined. However, the references provide no further details of how to accomplish such combination.

GENERAL DISCLOSURE OF THE INVENTION

It is an objective of the present invention to provide increased computational efficiency on the decoder side by combining the reconstruction of the N audio objects from M audio signals on the one hand, and rendering the N audio objects to form an audio output on the other hand.

According to a first aspect of the present invention, this and other objectives is achieved by a method for integrated rendering based on a data stream including:

- M audio signals which are combinations of N audio objects, wherein N>1 and M≤N,
- side information including a series of reconstruction instances $c_i$, of a reconstruction matrix and first timing data defining transitions between the instances, the side information allowing reconstruction of the N audio objects from the M audio signals, and
- time-variable object metadata including a series of metadata instances $m_i$ defining spatial relationships between the N audio objects and second timing data defining transitions between the metadata instances.

The rendering includes generating a synchronized rendering matrix based on the object metadata, the first timing data, and information relating to a current playback system configuration, the synchronized rendering matrix having a rendering instance corresponding in time with each reconstruction instance, multiplying each reconstruction instance with a corresponding rendering instance to form a corresponding instance of an integrated rendering matrix, and applying the integrated rendering matrix to the M audio signals in order to render an audio output.

The instances of the synchronized rendering matrix are thus synchronized with the instances of the reconstruction matrix, such that each rendering matrix instance has a corresponding reconstruction matrix instance relating to (approximately) the same point in time. By providing a rendering matrix which is synchronized with the reconstruction matrix, these matrices can be combined (multiplied) to form an integrated rendering matrix with increased computational efficiency.

In some embodiments, the integrated rendering matrix is applied using the first timing data to interpolate between instances of the integrated rendering matrix.

The synchronized rendering matrix can be generated in various ways, some of which are outlined in dependent claims, and also described in more detail below. For example, the generation can include resampling the object metadata, using the first timing data, to form synchronized metadata, and consequently generating the synchronized rendering matrix based on the synchronized metadata and the information relating to a current playback system configuration.

In some embodiments, the side information further includes a decorrelation matrix, and the method further comprises generating a set of K decorrelation input signals by applying a matrix to the M audio signals, the matrix formed by the decorrelation matrix and the reconstruction matrix, decorrelating the K decorrelation input signals to form K decorrelated audio signals, multiplying each instance of the decorrelation matrix with a corresponding rendering instance to form a corresponding instance of an integrated decorrelation matrix, and applying the integrated decorrelation matrix to the K decorrelated audio signals in order to generate a decorrelation contribution to the rendered audio output.

Such decorrelation contribution is sometimes referred to as a "wet" contribution to the audio output.

According to a second aspect of the present invention, this and other objectives is achieved by a method for adaptive rendering of audio signals based on a data stream including:

- M audio signals which are combinations of N audio objects, wherein N>1 and M≤N, side information including a series of reconstruction instances allowing reconstruction of the N audio objects from the M audio signals, upmix metadata including a series of metadata instances defining spatial relationships between the N audio objects, and downmix metadata including a series of metadata instances defining spatial relationships between the M audio signals.

The method further includes selectively performing one of the following steps:

i) providing an audio output based on the M audio signals using the side information, the upmix metadata, and information relating to a current playback system configuration, and ii) providing an audio output based on the M audio signals using the downmix metadata and information relating to a current playback system configuration.

According to this aspect of the invention, object reconstruction provided by the side information is not always performed. Instead, a more rudimentary "downmix rendering" is performed when this is deemed appropriate. It is noted that such downmix rendering does not include any object reconstruction.

In one embodiment, the reconstruction and rendering in step i) is an integrated rendering according to the first aspect of the invention. However, it is noted that the principles of the second aspect of the invention are not strictly restricted to an implementation based on the first aspect of the present invention. On the contrary, step i) may use the side information in other ways, including a separate reconstruction using side information followed by a rendering using the metadata.

The selection of rendering can be based on the number M of audio signals and number CH of channels in the audio output. For example, rendering with object reconstruction may be appropriate when M<CH.

A third aspect of the invention relates to a decoder system for rendering an audio output based on an audio data stream, comprising:

a receiver for receiving a data stream including:

M audio signals which are combinations of N audio objects, wherein N>1 and M≤N, side information including a series of reconstruction instances $c_i$ of a reconstruction matrix C and first timing data defining transitions between the instances, the side information allowing reconstruction of the N audio objects from the M audio signals, and time-variable object metadata including a series of metadata instances $m_i$ defining spatial relationships between the N audio objects and second timing data defining transitions between the metadata instances;

a matrix generator for generating a synchronized rendering matrix based on the object metadata, the first timing data, and information relating to a current playback system configuration, the synchronized rendering matrix having a rendering instance for each reconstruction instance, and an integrated renderer including a matrix combiner for multiplying each reconstruction instance with a corresponding rendering instance to form a corresponding instance of an integrated rendering matrix, and a matrix transform for applying the integrated rendering matrix to the M audio signals in order to render an audio output.

A fourth aspect of the invention relates to a decoder system for adaptive rendering of audio signals, comprising:

a receiver for receiving a data stream including:

M audio signals which are combinations of N audio objects, wherein N>1 and M≤N, side information including a series of reconstruction instances $c_i$ allowing reconstruction of the N audio objects from the M audio signals, upmix metadata including a series of metadata instances defining spatial relationships between the N audio objects, and downmix metadata including a series of metadata instances defining spatial relationships between the M audio signals;

a first rendering function configured to provide an audio output based on the M audio signals using the side information, the upmix metadata, and information relating to a current playback system configuration;

a second rendering function configured to provide an audio output based on the M audio signals using the downmix metadata and information relating to a current playback system configuration; and processing logic for selectively activating the first rendering function or the second rendering function.

A fifth aspect of the invention relates to a computer program product comprising computer program code portions which, when executed on a computer processor, enable the computer processor to perform the steps of the method according to the first or second aspect. The computer program product may be stored on a non-transitory computer-readable medium.

BRIEF DESCRIPTION OF THE DRAWINGS

The present invention will be described in more detail with reference to the appended drawings, showing currently preferred embodiments of the invention.

DETAILED DESCRIPTION OF CURRENTLY PREFERRED EMBODIMENTS

Systems and methods disclosed in the following may be implemented as software, firmware, hardware or a combination thereof. In a hardware implementation, the division of tasks referred to as "stages" in the below description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

Figure 1:
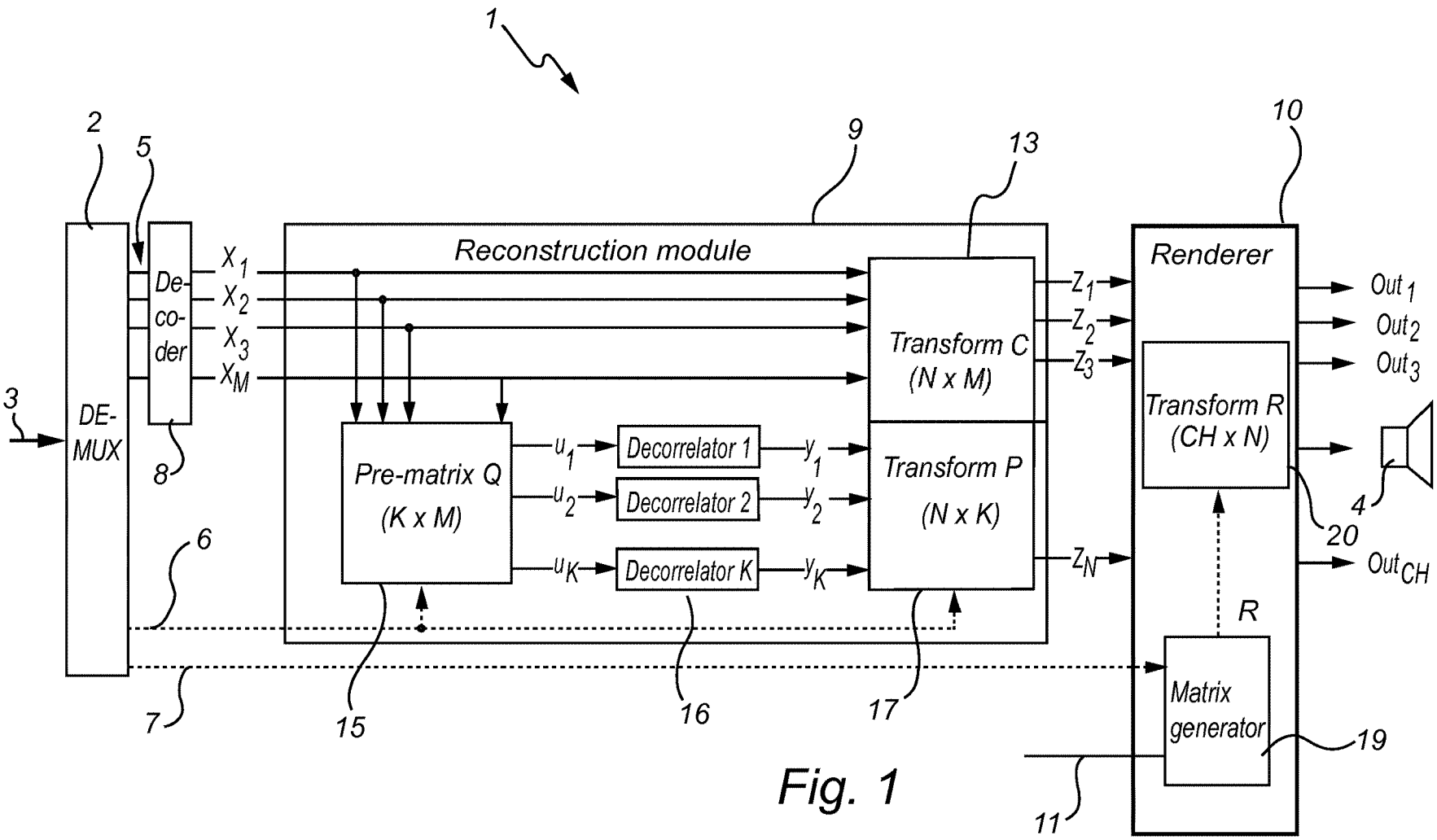
FIG. 1 schematically shows a decoder system according to prior art.

FIG. 1 shows an example of a prior art decoding system 1, configured to perform reconstruction of N audio objects ($z_1, z_2, \ldots z_N$) from M audio signals ($x_1, x_2, \ldots x_M$), and then render the audio objects for a given playback system configuration. Such a system (and a corresponding encoder system) is disclosed in WO2014187991 and WO2015150384, hereby incorporated by reference.

The system 1 includes a DEMUX 2 configured to receive a data stream 3 and divide it into M encoded audio signals 5, side information 6, and object metadata 7. The side information 6 includes parameters allowing reconstruction of the N audio objects from the M audio signals. The object metadata 7 includes parameters defining the spatial relationship between the N audio objects, which, in combination with information about the intended playback system configuration, e.g. number and location of speakers, will allow rendering of an audio signal presentation for this playback system. This presentation may be e.g. a 5.1 surround presentation or a 7.1.4 immersive presentation.

As the metadata 7 is configured to be applied to the N reconstructed audio objects, it is sometimes referred to as "upmix" metadata. The data stream 3 may include "downmix" metadata 12, which may be used in the decoder 1 to render the M audio signals without reconstructing the N audio objects. Such a decoder is sometimes referred to as a "core decoder", and will be further discussed with reference to FIG. 7.

The data stream 3 is typically divided into frames, each frame typically corresponds to a constant "stride" or "frame length/duration" in time, which can also be expressed as a frame rate. Typical frame durations are 2048/48000 Hz=42.7 ms (i.e. 23.44 Hz frame rate), or 1920/48000 Hz=40 ms (i.e. 25 Hz frame rate). In most practical cases, the audio signals are sampled, and each frame then includes a defined number of samples.

The side information 6 and the object metadata 7 are time dependent, and hence may vary with time. The time variation of side information and metadata may be at least partly synchronized with the frame rate, although this is not necessary. Further, the side information is typically frequency dependent, and divided into frequency bands. Such frequency bands can be formed by grouping bands from a complex QMF bank in a perceptually motivated way.

The metadata, on the other hand, is typically broad band, i.e. one data for all frequencies.

The system further comprises a decoder 8, configured to decode the M audio signals ($x_1, x_2, \ldots x_M$), and an object reconstructing module 9 configured to reconstruct the N audio objects ($z_1, z_2, \ldots z_N$) based on the M decoded audio signals ($x_1, x_2, \ldots x_M$) and the side information 6. A renderer 10 is arranged to receive the N audio objects 2, and to render a set of CH audio channels ($out_1, out_2, out_{CH}$) for playback based on the N audio objects ($z_1, z_2, \ldots z_N$), the object metadata 7 and information 11 about the playback configuration.

The side information 6 includes instances (values) ($c_i$) of a time-variable reconstruction matrix C (size N×M) and timing data td defining transitions between these instances. Each frequency band may have different reconstruction matrices C, but the timing data will be the same for all bands.

Many formats are possible for the timing data. As s simple example, the timing data simply indicates a point in time for an instantaneous change from one instance to the next. However, more elaborate formats of timing data may be advantageous in order to provide a smoother transition between instances. As one example, the side information 6 can include a series of data sets, each set including a point in time ($tc_i$) indicating the beginning of a ramp change, a ramp duration ($dc_i$), and a matrix value ($c_i$) to be assumed after the ramp duration (i.e. at $tc_i+dc_i$). A ramp thus represents the linear transition from the matrix values of a previous instance ($c_{i-1}$) to the matrix values of a next instance ($c_i$). Of course, other alternatives of timing formats are also possible, including more complex formats.

The reconstruction module 9 comprises a matrix transform 13 configured to apply the matrix C to the M audio signals to reconstruct the N audio objects. The transform 13 will interpolate the matrix C (in each frequency band), i.e. interpolate all matrix elements with a linear (temporal) ramp from the previous to the new value, between the instances $c_i$ based on the timing data, in order to enable continuous application of the matrix to the M audio signals (or, in most practical implementations, to each sample of sampled audio signals).

The matrix C by itself is typically not capable of re-instating the original covariance between all reconstructed objects. This can be perceived as "spatial collapse" in the rendered presentation played over loudspeakers. To reduce this artifact, decorrelation modules can be introduced in the decoding process. They enable an improved or complete re-instatement of the object covariance. Perceptually, this reduces the potential "spatial collapse" and achieves an improved reconstruction of the original "ambience" of the rendered presentation. Details of such processing can be found e.g. in WO2015059152.

For this purpose, the side information 6 in the illustrated example also includes instances $p_i$ of a time variable decorrelation matrix P, and the reconstruction module 9 here includes a pre-matrix transform 15, a decorrelator stage 16 and a further matrix transform 17. The pre-matrix transform 15 is configured to apply a matrix Q (which is computed from the matrix C and the decorrelation matrix P) to provide an additional set of K decorrelation input signals ($u_1, u_2, \ldots u_K$). The decorrelator stage 16 is configured to receive the K decorrelation input signals and decorrelate them. The matrix transform 17, finally, is configured to apply the decorrelation matrix P to the decorrelated signals ($y_1, y_2, \ldots y_K$) to provide a further "wet" contribution to the N audio objects. Similar to the matrix transform 13, the matrix transforms 15 and 17 are applied independently in each frequency band, and use the side information timing data ($tc_i$, $dc_i$) to interpolate between instances ($p_i$) of the matrix P and Q respectively. It is noted that the interpolation of the matrices P and Q thus is defined by the same timing data as the interpolation of the matrix C.

Similar to the side information 6, the object metadata 7 includes instances ($m_i$) and timing data defining transitions between these instances. For example, the object metadata 7 can include a series of data sets, each including a ramp start point in time ($tm_i$), a ramp duration ($dm_i$), and a matrix value ($m_i$) to be assumed after the ramp duration (i.e. at $tm_i+dm_i$). However, it is noted that the timing of the metadata is not necessarily the same as the timing of the side information.

The renderer 10 includes a matrix generator 19, configured to generate a time variable rendering matrix R of size CH×N, based on the object metadata 7 and the information 11 about the playback system configuration (e.g. number and location of speakers). The timing of the metadata is maintained, so that the matrix R includes a series of instances ($r_i$). The renderer 10 further includes a matrix transform 20, configured to apply the matrix R to the N audio objects. Similar to the transform 13, the transform 20 interpolates between instances $r_i$ of the matrix R in order to apply the matrix R continuously or at least to each sample of the N audio objects.

Figure 2:
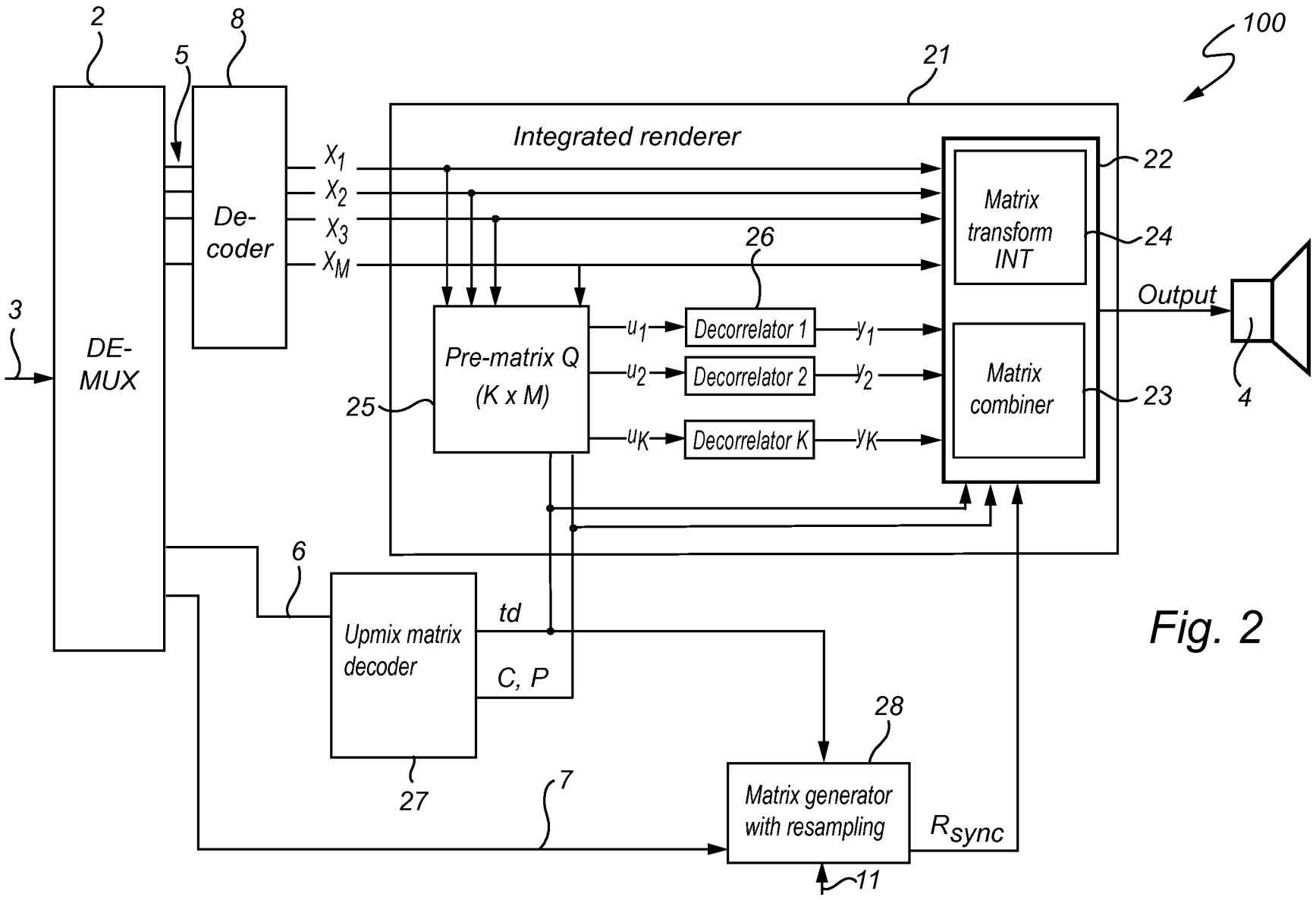
FIG. 2 is a schematic block diagram of integrated reconstruction and rendering according to an embodiment of the present invention.

FIG. 2 shows a modification of the decoder system in FIG. 1, according to an embodiment of the present invention. Just like the decoder system in FIG. 1, the decoder system 100 in FIG. 2 includes a DEMUX 2 configured to receive a data stream 3 and divide it into M encoded audio signals 5, side information 6, and object metadata 7. Also similar to FIG. 1, the audio output from the decoder is a set of CH audio channels ($out_1$, $out_2$, . . . $out_{CH}$) for playback on a specified playback system.

The most important difference between the decoder 100 and the prior art is that the reconstruction of N audio objects and rendering of the audio output channels here are combined (integrated) into one single module, referred to as an integrated renderer 21.

The integrated renderer 21 includes a matrix application module 22, including a matrix combiner 23 and a matrix transform 24. The matrix combiner 23 is connected to receive the side information (instances of C and timing) and also a rendering matrix $R_{sync}$ which is synchronized with the matrix C. The combiner 23 is further configured to combine the matrices C and R into one integrated time variable matrix INT, i.e. a set of matrix instances $INT_i$ and associated timing data (which corresponds to the timing data in the side information). The matrix transform 24 is configured to apply the matrix INT to the M audio signals ($x_1$, $x_2$, . . . $x_M$), in order to provide the CH channels of the audio output. In this basic example, the matrix INT thus has a size of CH×M. The transform 24 will interpolate the matrix INT between the instances $INT_i$ based on the timing data, in order to enable application of the matrix INT to each sample of the M audio signals.

It is noted that the interpolation of the combined matrix INT in transform 24 will not be mathematically identical as the consecutive application of two interpolated matrixes C and R. However, this deviation has been found not to result in any perceptual degradation.

In analogy with FIG. 1, the side information 6 in the illustrated example also includes instances $p_i$ of a time variable decorrelation matrix P including a "wet" contribution to the audio presentation. For this purpose, the integrated renderer 21 may further include a pre-matrix transform 25 and a decorrelator stage 26. Similar to the transform 15 and stage 16 in FIG. 1, the transform 25 and decorrelator stage 26 are configured to apply a matrix Q formed by the decorrelation matrix P in combination with the matrix C to provide an additional set of K decorrelation input signals ($u_1$, $u_2$, $u_K$), and to decorrelate the K signals to provide decorrelated signals ($y_1$, $y_2$, . . . $y_K$).

However, contrary to FIG. 1, the integrated renderer does not include a separate matrix transform for applying the matrix P to the decorrelated signals ($y_1$, $y_2$, . . . $y_K$). Instead, the matrix combiner 23 of the matrix application module 22 is configured to combine all three matrices C, P and $R_{sync}$ into the integrated matrix INT which is applied by the transform 24. In the illustrated case, the matrix application module thus receives M+K signals (M audio signals ($x_1$, $x_2$, . . . $x_M$) and K decorrelated signals ($y_1$, $y_2$, . . . $y_K$)) and provides CH audio output channels. The integrated matrix INT in FIG. 2 thus has a size of CH×(M+K).

Another way to describe this is that the matrix transform 24 in the integrated renderer 21 in fact applies two integrated matrices INT1 and INT2 to form two contributions to the audio output. A first contribution is formed by applying an integrated matrix INT1 of size CH×M to the M audio signals ($x_1$, $x_2$, . . . $x_M$), and a second contribution is formed by applying an integrated "reverberation" matrix INT2 of size CH×K to the K decorrelated signals ($y_1$, $y_2$, $y_K$).

In addition to the integrated renderer 21, the decoder side in FIG. 2 includes a side information decoder 27 and a matrix generator 28. The side information decoder is simply configured to separate (decode) the matrix instances $c_i$ and $p_i$ from the timing data td, i.e., $tc_i$, $dc_i$. It is recalled that the matrices C and P both have the same timing. It is noted that this separation of matrix values and timing data obviously was done also in the prior art, in order to enable interpolation of the matrices C and P, although not explicitly shown in FIG. 1. As will be evident in the following, according to the present invention, the timing data td is required in several different functional blocks, hence the illustration of the decoder 27 as a separate block in FIG. 2.

The matrix generator 28 is configured to generate the synchronized rendering matrix $R_{sync}$ by resampling the metadata 7 using the timing data td received from the decoder 27. Various approaches are possible for this resampling, and three examples will be discussed with reference to FIGS. 3-6.

It should be noted that although in the present disclosure the timing data td of the side information is used to govern the synchronization process, this is not a restriction of the inventive concept. On the contrary, it would e.g. be possible to instead use the timing of the metadata to govern the synchronization, or by some combination of the various timing data.

Figure 3:
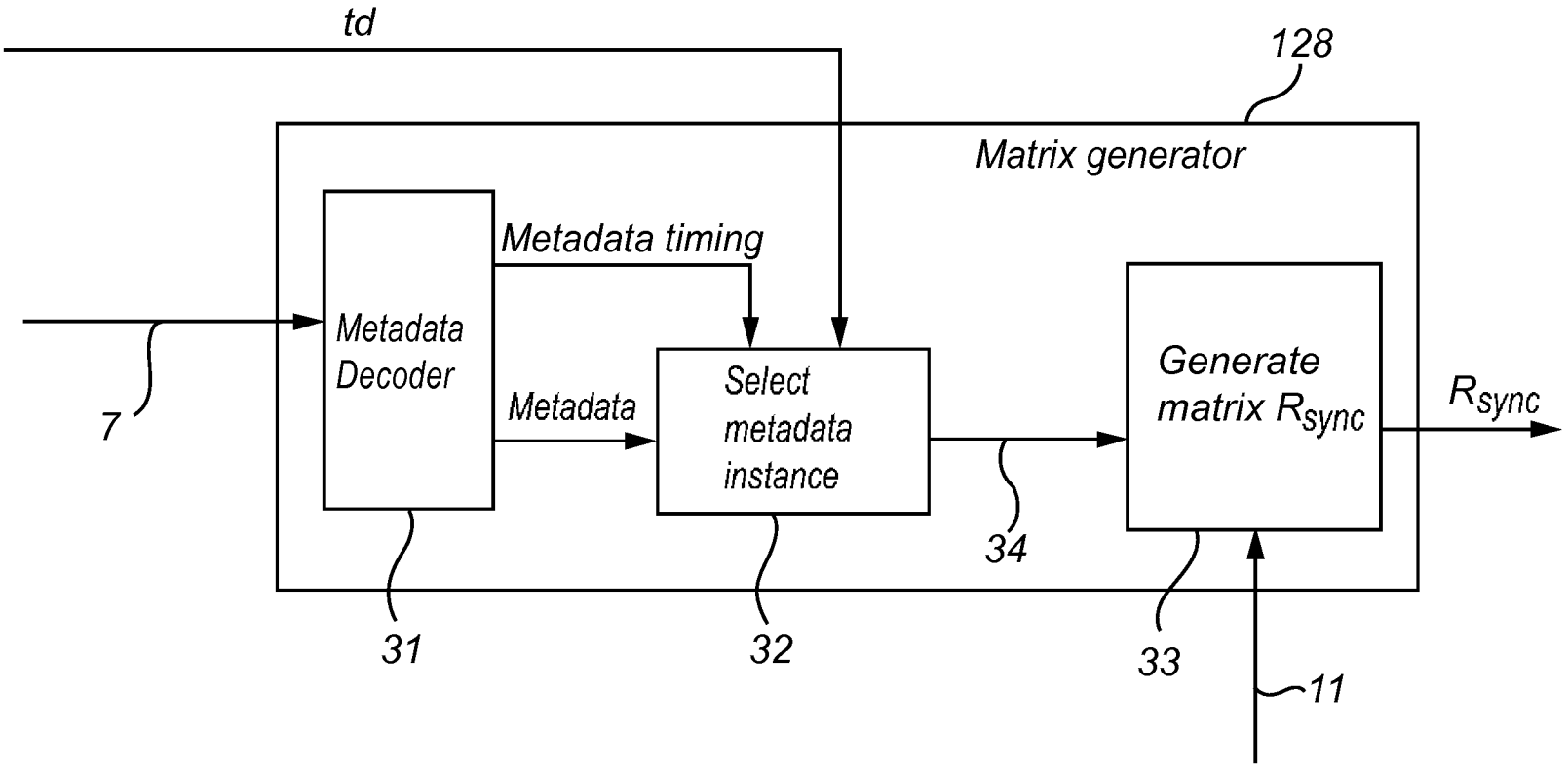
FIG. 3 is a schematic block diagram of a first example of the matrix generator and resampling module in FIG. 2.

In FIG. 3, the matrix generator 128 comprises a metadata decoder 31, a metadata select module 32, and a matrix generator 33. The metadata decoder is configured to separate (decode) the metadata 7 in the same way as the decoder 27 in FIG. 2 separates the side information 6. The separated components of the metadata, i.e. the matrix instances $m_i$ and the metadata timing ($tm_i$, $dm_i$) are supplied to the metadata select module 32. It is again noted that the metadata timing $tm_i$, $dm_i$ may be different from the side information timing data $tc_i$, $dc_i$.

Module 32 is configured to select, for each instance of the side information, an appropriate instance of the metadata. A special case of this is of course when there is a metadata instance corresponding to each side information instance.

If the metadata is unsynchronized with the side information, a practical approach may be to simply use the most recent metadata instance relative to the timing of the side information instance. If the data (audio signals, side information and metadata) is received in frames, the current frame does not necessarily include a metadata instance preceding the first side information instance. In that case, a preceding metadata instance may be acquired from a previous frame. If that is not possible, the first available metadata instance can be used.

Another, potentially more effective, approach is to use a metadata instance closest in time with respect to the side information instance. If the data is received in frames, and data in neighboring frames is not available, the expression "closest in time" will refer to the current frame.

The output from the module 32 will be a set of metadata instances 34 fully synchronized with the side information instances. Such metadata will be referred to as "synchronized metadata". The matrix generator 33, finally, is configured to generate the synchronized matrix $R_{sync}$ based on the synchronized metadata 34 and the information about playback system configuration 11. The function of the generator 33 essentially corresponds to that of the matrix generator 19 in FIG. 1, but taking synchronized metadata as input.

Figure 4:
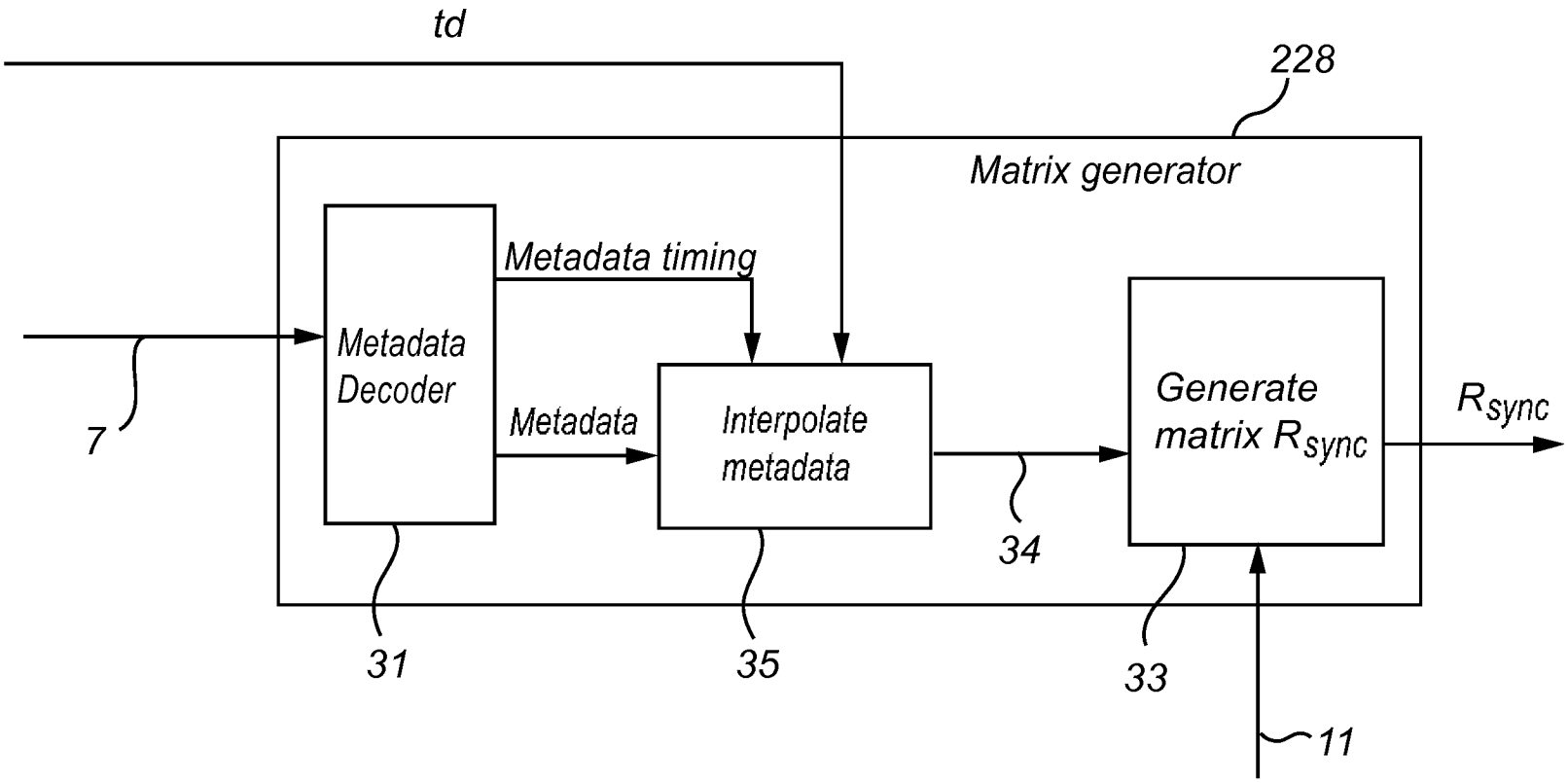
FIG. 4 is a schematic block diagram of a second example of the matrix generator and resampling module in FIG. 2.

In FIG. 4, the matrix generator 228 again comprises a metadata decoder 31 and a matrix generator 33 similar to those described with reference to FIG. 3, and will not be further discussed here. However, instead of a metadata select module, the matrix generator 228 in FIG. 4 includes a metadata interpolation module 35.

In a situation where there is no metadata instance available for a specific time point in the side information timing data, module 35 is configured to interpolate between two consecutive metadata instances immediately before and immediately after the time point, in order to reconstruct a metadata instance corresponding to the time point.

The output from the module 35 will again be a set of synchronized metadata instances 34 fully synchronized with the side information instances. This synchronized metadata will be used in the generator 33 to generate the synchronized rendering matrix $R_{sync}$.

It is noted that the examples in FIGS. 3 and 4 also may be combined, such that a selection according to FIG. 3 is performed when appropriate, and an interpolation according to FIG. 4 otherwise.

Figure 5:
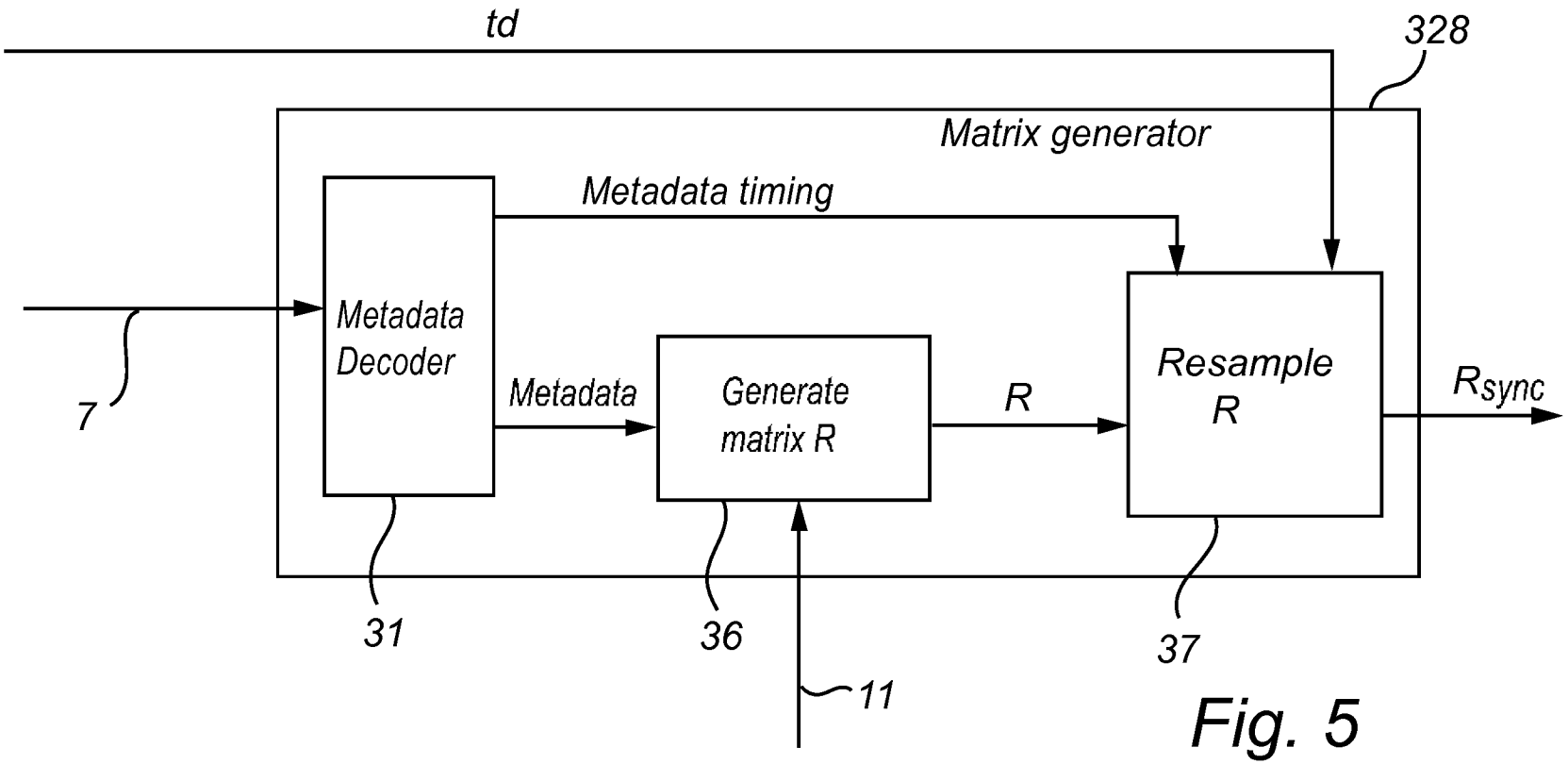
FIG. 5 is a schematic block diagram of a third example of the matrix generator and resampling module in FIG. 2.

Compared to FIGS. 3 and 4, the processing in FIG. 5 is basically in the reverse order, i.e. first generating a rendering matrix R using the metadata, and only then synchronizing with the side information timing.

In FIG. 5, the matrix generator 328 again comprises a metadata decoder 31 which has been described above. The generator 328 further includes a matrix generator 36 and an interpolation module 37.

The matrix generator 36 is configured to generate a matrix R based on the original metadata instances ($m_i$) and the information about playback system configuration 11. The function of the generator 36 thus fully corresponds to that of the matrix generator 19 in FIG. 1. The output is the "conventional" matrix R.

The interpolation module 37 is connected to receive the matrix R, as well as the side information timing data td ($tc_i$, $dc_i$) and metadata timing data $tm_i$, $dm_i$. Based on this data, the module 37 is configured to resample the matrix R in order to generate a synchronized matrix $R_{sync}$ which is synchronized with the side information timing data. The resampling process in module 37 may be a selection (according to module 32) or an interpolation (according to module 35).

Some examples of resampling processes will now be discussed in more detail, with reference to FIG. 6. It is here assumed that the timing data for a given side information instance $c_i$ has the format discussed above, i.e. it includes a ramp start time $tc_i$ and a duration $dc_i$ of a linear ramp from the previous instance $c_{i-1}$ to the instance $c_i$. It is noted that the matrix values of instance $c_i$ reached at the ramp end time $tc_i+dc_i$ of the interpolation ramp will remain valid until the ramp start time $tc_{i+1}$ of the following instance $c_{i+1}$. Similarly, the timing data for a given metadata instance $m_i$ is provided by a ramp start time $tm_i$ and a duration $dm_i$ of a linear ramp from the previous instance $m_{i-1}$ to the instance $m_i$.

Figure 6A:
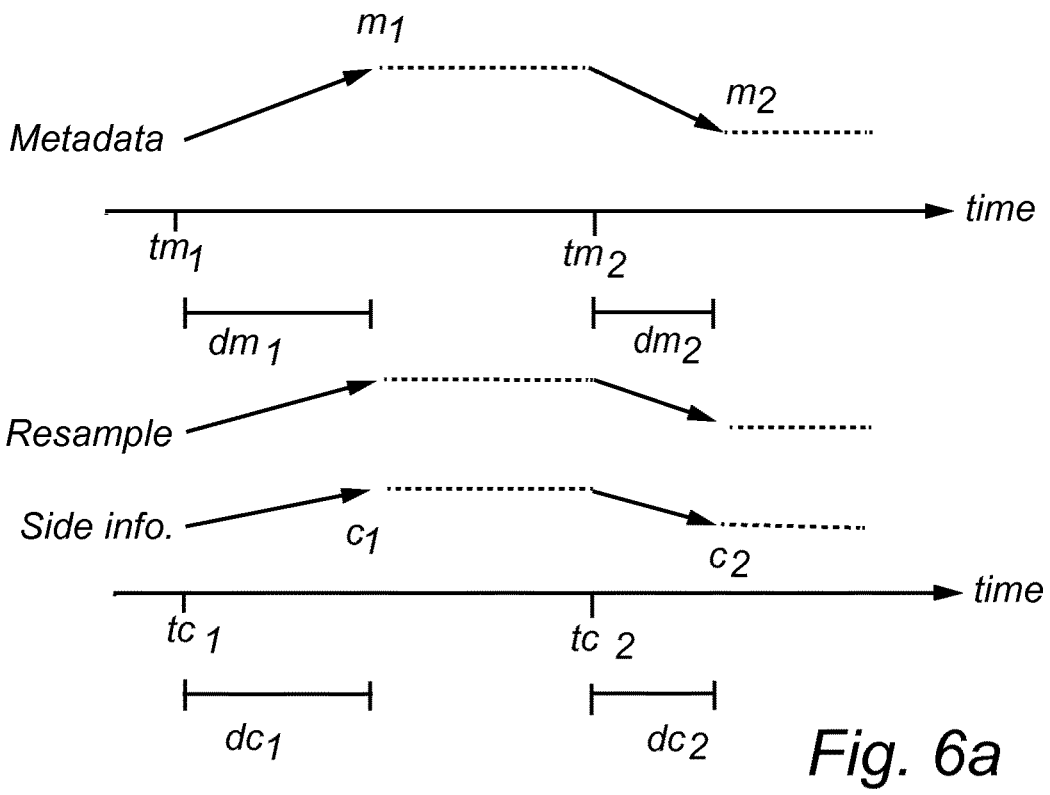
FIG. 6*a-c* are examples of metadata resampling according to embodiments of the present invention.

In a first, very simple case, the timing data of the side information and the metadata coincide, i.e. $tc_i=tm_i$ and $dc_i=dm_i$. The metadata select module 32 in FIG. 3 then simply selects the corresponding metadata instance, as illustrated in FIG. 6*a*. Metadata instances $m_1$ and $m_2$ are combined with side information instances $c_1$ and $c_2$ to form instances $r_1$ and $r_2$ of the synchronized matrix $R_{sync}$.

Figure 6B:
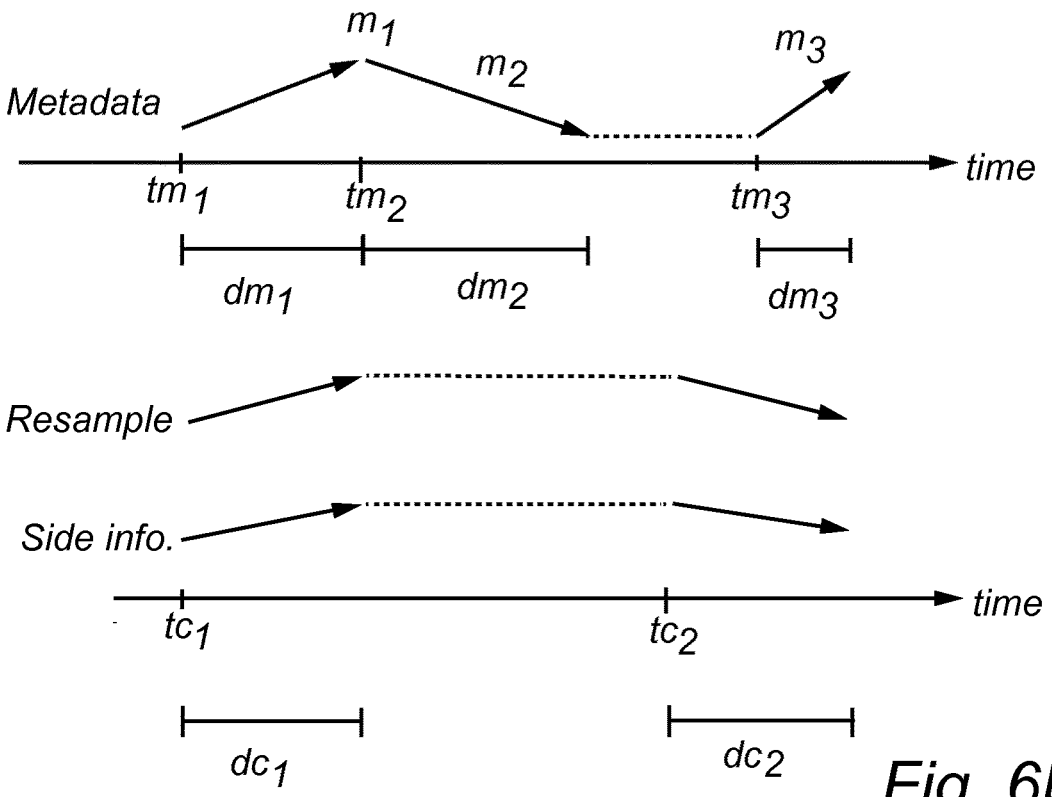

FIG. 6*b* shows another situation, where there is a metadata instance corresponding to each side information instance, but also additional metadata instances in between. In FIG. 6*b*, the module 32 will select metadata instances $m_1$ and $m_3$ (in combination with side information instances $c_1$ and $c_2$) to form instances $r_1$ and $r_2$ of the synchronized matrix $R_{sync}$. Metadata instance $m_2$ will be discarded.

In FIG. 6*b*, it is noted that "corresponding" instances may coincide as in FIG. 6*a*, i.e. have both ramp starting point and ramp duration in common. This is the case for $c_1$.and $m_1$, where $tc_1$, is equal to $tm_1$ and $dc_1$ is equal to $dm_i$. Alternatively, "corresponding" instances only have the ramp end points in common. This is the case for $c_2$.and $m_3$, where $tc_2+dc_2$ is equal to $tm_3+dm_3$.

Figure 6C:
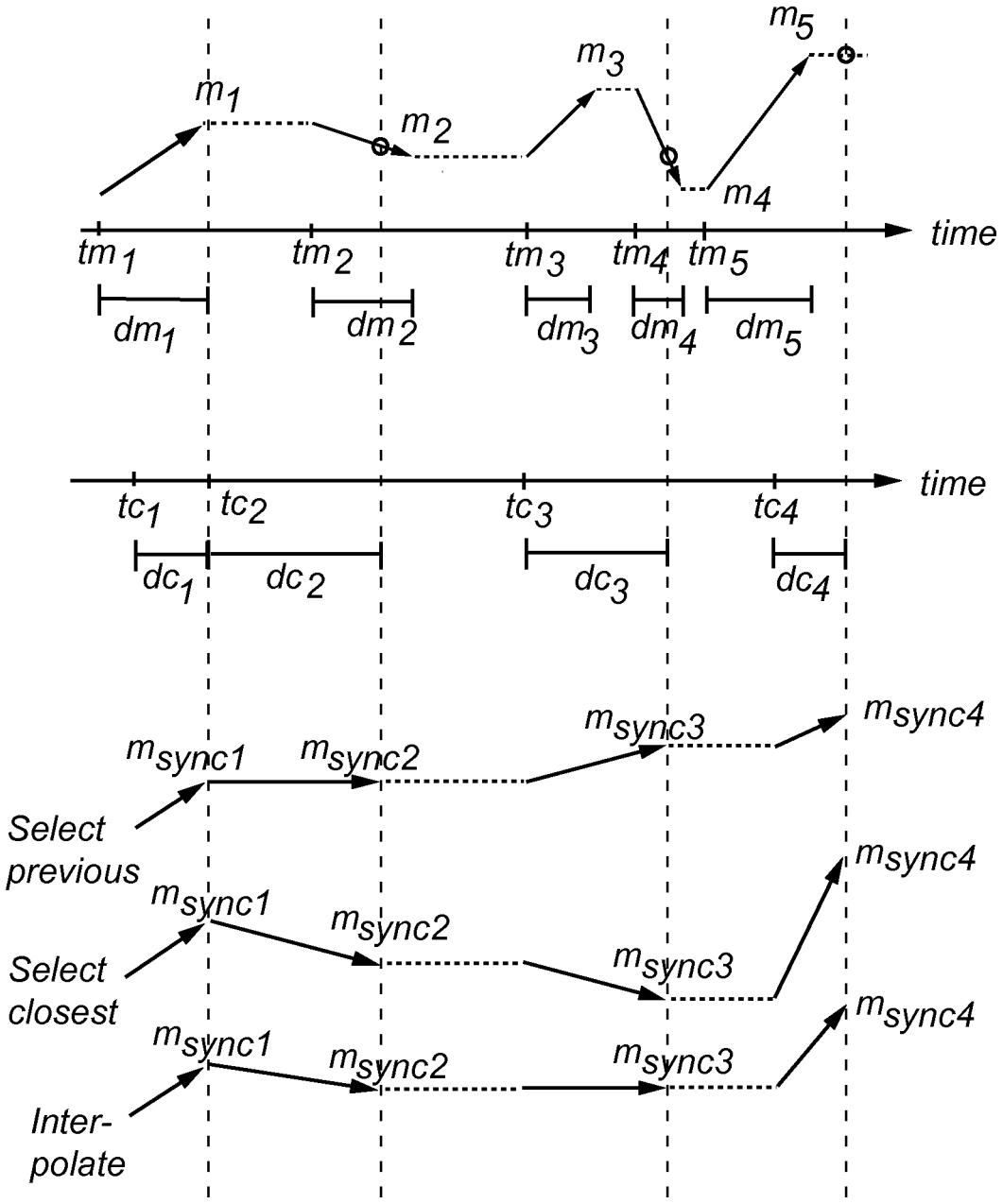

In FIG. 6*c*, various examples are provided where the metadata is not synchronized with the side information, such that an exactly corresponding instance cannot always be found.

At the top of FIG. 6*c* is illustrated metadata including five instances ($m_1$-$m_5$) and a time line with the associated timing ($tm_i$, $dm_i$). Below this is a second time line with the side information timing ($tc_i$, $dc_i$). Below this are three different examples of synchronized metadata.

In the first example, labelled "Select previous", the most recent metadata instance is used as synchronized metadata instance. The meaning of "most recent" may depend on the implementation. One possible option is to use the last metadata instance with a ramp start before the ramp end of the side information. Another option, which is illustrated here, is to use the last metadata instance with a ramp end ($tm_i+dm_i$) before or at the side information ramp end ($tc_i+dc_i$). In the illustrated case this results in the first synchronized metadata instance $m_{sync1}$ being equal to $m_1$, $m_{sync2}$ is also equal to $m_1$, $m_{sync3}$ is equal to $m_3$, and $m_{sync4}$ is equal to $m_5$. Metadata $m_2$ and $m_4$ is discarded.

In the next example, labelled "Select closest", the metadata instance which has a ramp end closest in time to the side information ramp end is used. In other words, the synchronized metadata instance is not necessarily a previous instance, but may be a future instance if this is closer in time. In this case, the synchronized metadata will be different, and as is clear from the figure, $m_{sync1}$ is equal to $m_1$, $m_{sync2}$ is also equal to $m_2$, $m_{sync3}$ is equal to $m_4$, and $m_{sync4}$ is equal to $m_5$. In this case, only metadata $m_3$ is discarded.

In yet another example, labelled "Interpolate", the metadata is interpolated, as was discussed with reference to FIG. 4. Here, $m_{sync1}$ will again be equal to $m_1$, as the side information ramp end and metadata ramp end in fact coincide. However, $m_{sync2}$ and $m_{sync3}$ will be equal to interpolated values of the metadata, as indicated by ring marks in the metadata in the top of FIG. 6*c*. In particular, $m_{sync2}$ is an interpolated value of the metadata between $m_1$ and $m_2$, and $m_{sync3}$ is an interpolated value of the metadata between $m_3$ and $m_4$. Finally, $m_{sync4}$, which has a ramp end after the ramp end of $m_5$, will be a forward interpolation of this ramp, again indicated at the top of FIG. 6*c*.

It is noted that FIG. 6*c* assumes processing according to FIG. 3 or 4. If processing according to FIG. 5 is applied, then it is the instances of the matrix R that will be resampled, typically using the interpolation approach.

Figure 7:
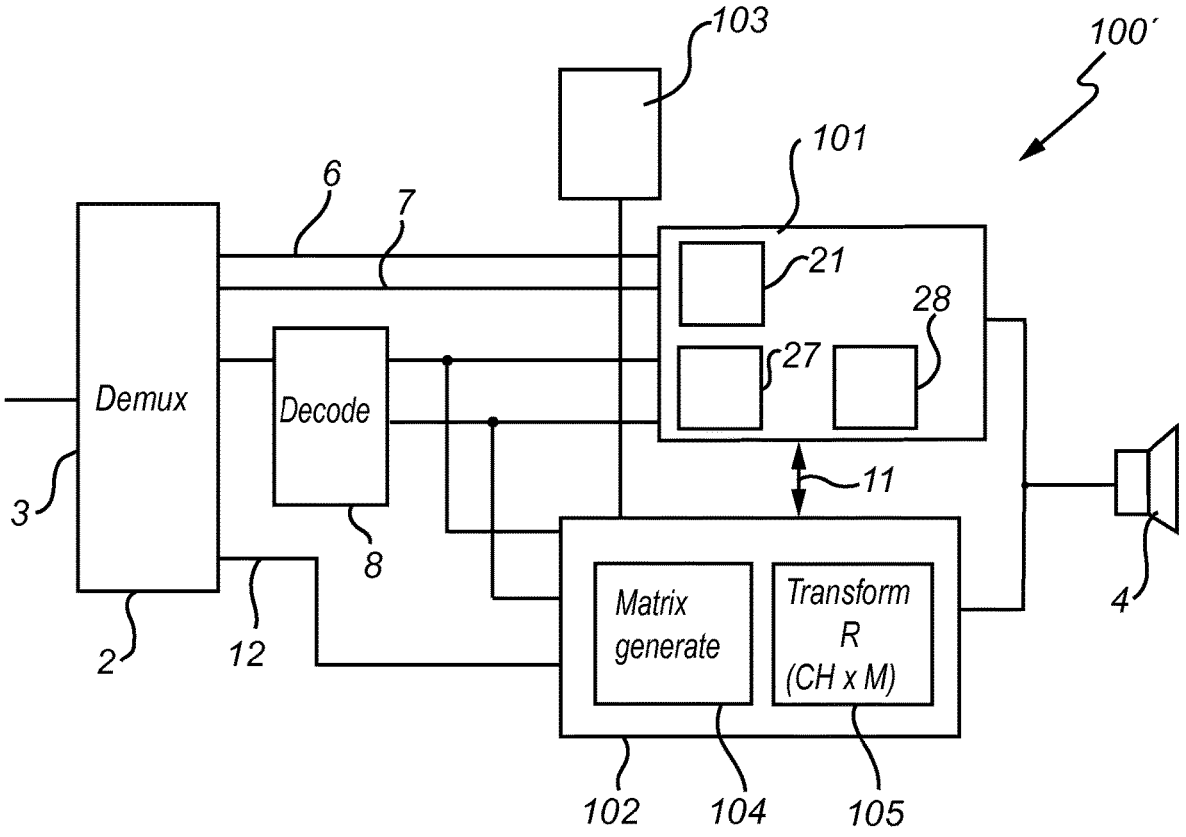
FIG. 7 is a schematic block diagram of a decoder according to a further aspect of the present invention.

In order to further reduce computational complexity, the integrated rendering discussed above may be selectively applied when appropriate, and otherwise a direct rendering of the M audio signals may be performed (also referred to as "downmix rendering"). This is illustrated in FIG. 7.

Similar to the decoder in FIG. 2, the decoder 100' in FIG. 7 again includes a demux 2 and a decoder 8. The decoder 100' further includes two different rendering functions 101 and 102, and processing logic 103 for selectively activating one of the functions 101, 102. The first function 101 corresponds to the integrated rendering function illustrated in FIG. 2 and will not be described in further detail here. The second function 102 is a "core decoder" as was mentioned briefly above. The core decoder 102 includes a matrix generator 104 and a matrix transform 105.

It is recalled that the data stream 3 includes M encoded audio signals 5, side information 6, "upmix" metadata 7 and "downmix" metadata 12. The integrated rendering function 101 receives the decoded M audio signals ($x_1, x_2, \ldots x_M$), the side information 6 and "upmix" metadata 7. The core decoder function 102 receives the decoded M audio signals ($x_1, x_2, \ldots x_M$) and the "downmix" metadata 12. Finally, both functions 101, 102 receive the loudspeaker system configuration information 11.

In this embodiment, the processing logic 103 will determine which function 101 or 102 is appropriate and activate this function. If the integrated rendering function 101 is activated, the M audio signals will be rendered as described above with reference to FIGS. 2-6.

If, on the other hand, the downmix rendering function 102 is activated, the matrix generator 104 will generate a rendering matrix $R_{core}$ of size CH×M based on the "downmix" metadata 12 and the configuration information 11. The matrix transform 105 will then apply this rendering matrix $R_{core}$ to the M audio signals ($x_1, x_2, \ldots x_M$) to form the audio output (CH channels).

The decision in the processing logic 103 may depend on various factors. In one embodiment, the number of output signals M and the number of output channels CH are used to select the appropriate rendering function. According to a simple example, the processing logic 103 selects the first rendering function (e.g. integrated rendering) if M<CH, and selects the second rendering function (downmix rendering) otherwise.

The person skilled in the art realizes that the present invention by no means is limited to the preferred embodiments described above. On the contrary, many modifications and variations are possible within the scope of the appended claims. For example, and as mentioned above, different types of timing data formats may be employed. Further, synchronization of the rendering matrix may be effected in other ways than the ones disclosed herein by way of example.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Various aspects of the present invention may be appreciated from the following enumerated example embodiments (EEEs):

EEE1. A method for rendering an audio output based on an audio data stream, comprising:

receiving a data stream including:

M audio signals which are combinations of N audio objects, wherein N>1 and M≤N, side information including a series of reconstruction instances $c_i$ of a reconstruction matrix C and first timing data defining transitions between said instances, said side information allowing reconstruction of the N audio objects from the M audio signals, and time-variable object metadata including a series of metadata instances $m_i$ defining spatial relationships between the N audio objects and second timing data defining transitions between said metadata instances;

generating a synchronized rendering matrix $R_{sync}$ based on the object metadata, the first timing data, and information relating to a current playback system configuration, said synchronized rendering matrix $R_{sync}$ having a rendering instance $r_i$ for each reconstruction instance $c_i$;

multiplying each reconstruction instance $c_i$ with a corresponding rendering instance $r_i$ to form a corresponding instance of an integrated rendering matrix INT; and applying the integrated rendering matrix INT to the M audio signals in order to render an audio output.

EEE2. The method according to EEE 1, wherein the step of applying the integrated rendering matrix INT includes using the first timing data to interpolate between instances of the integrated rendering matrix INT.

EEE3. The method according to EEE 1 or 2, wherein the step of generating a synchronized rendering matrix $R_{sync}$ includes:

resampling the object metadata, using said first timing data, to form synchronized metadata, and consequently generating the synchronized rendering matrix $R_{sync}$ based on said synchronized metadata and said information relating to a current playback system configuration.

EEE4. The method according to EEE 3, wherein the resampling includes selecting, for each reconstruction instance $c_i$, an appropriate existing metadata instance $m_i$.

EEE5. The method according to EEE 3, wherein the resampling includes calculating, for each reconstruction instance $c_i$, a corresponding rendering instance by interpolating between existing metadata instances $m_i$.

EEE6. The method according to EEE 1 or 2, wherein the step of generating a synchronized rendering matrix $R_{sync}$ includes:

generating an non-synchronized rendering matrix R based on said object metadata and said information relating to a current playback system configuration, and consequently resampling said non-synchronized rendering matrix R, using said first timing data, in order to form the synchronized rendering matrix $R_{sync}$.

EEE7. The method according to EEE 6, wherein the resampling includes selecting, for each reconstruction instance $c_i$, an appropriate existing instance of the non-synchronized rendering matrix R.

EEE8. The method according to EEE 6, wherein the resampling includes calculating, for each reconstruction instance $c_i$, a corresponding rendering instance by interpolating between instances of the non-synchronized rendering matrix R.

EEE9. The method according to any one of the preceding EEEs, wherein said side information further includes a decorrelation matrix P, the method further comprising:

generating a set of K decorrelation input signals by applying a matrix Q to the M audio signals, said matrix Q computed from the decorrelation matrix P and the reconstruction matrix C, decorrelating said K decorrelation input signals to form K decorrelated audio signals;

multiplying each instance $p_i$ of the decorrelation matrix P with a corresponding rendering instance $r_i$ to form a corresponding instance of an integrated decorrelation matrix INT2; and applying the integrated decorrelation matrix INT2 to the K decorrelated audio signals in order to generate a decorrelation contribution to the rendered audio output.

EEE10. The method according to any one of the preceding EEEs, wherein said first timing data includes, for each reconstruction instance $c_i$, a ramp start time $tc_i$ and a ramp duration $dc_i$, and wherein a transition from a preceding instance $c_{i-1}$ to the instance $c_i$ is a linear ramp with duration $dc_i$ starting at $tc_i$.

EEE11. The method according to any one of the preceding EEEs, wherein said second timing data includes, for each metadata instance $m_i$, a ramp start time $tm_i$ and a ramp duration $dm_i$, and a transition from a preceding instance $m_{i-1}$ to the instance $m_i$ is a linear ramp with duration $dm_i$ starting at $tm_i$.

EEE12. The method according to any one of the preceding EEEs, wherein the data stream is encoded, and the method further comprises decoding the M audio signals, the side information and the metadata.

EEE13. A method for adaptive rendering of audio signals, comprising:

receiving a data stream including:

M audio signals which are combinations of N audio objects, wherein N>1 and M≤N, side information including a series of reconstruction instances $c_i$ allowing reconstruction of the N audio objects from the M audio signals, upmix metadata including a series of metadata instances $m_i$ defining spatial relationships between the N audio objects, and downmix metadata including a series of metadata instances $m_{dmx,i}$ defining spatial relationships between the M audio signals; and selectively performing one of the following steps:

i) providing an audio output based on the M audio signals using said side information, said upmix metadata, and information relating to a current playback system configuration, and ii) providing an audio output based on the M audio signals using said downmix metadata and information relating to a current playback system configuration.

EEE14. The method according to EEE 13, wherein the step i) of providing an audio output by reconstructing and rendering the M audio signals using said side information, said upmix metadata, and information relating to a current playback system configuration includes:

generating a synchronized rendering matrix $R_{sync}$ based on the object metadata, the first timing data, and information relating to a current playback system configuration, said synchronized rendering matrix $R_{sync}$ having a rendering instance $r_i$ for each reconstruction instance $c_i$;

multiplying each reconstruction instance $c_i$ with a corresponding rendering instance $r_i$ to form a corresponding instance of an integrated rendering matrix INT; and applying the integrated rendering matrix INT to the M audio signals in order to render an audio output.

EEE15. The method according to EEE 13 or 14, wherein the step ii) of providing an audio output by rendering the M audio signals using said downmix metadata and information relating to a current playback system configuration includes:

generating a rendering matrix $R_{core}$ based on the downmix metadata and the information relating to a current playback system, and applying said rendering matrix $R_{core}$ to the M audio signals to render the audio output.

EEE16. The method according to any one of EEEs 13-15, wherein the data stream is encoded, and the method further comprises decoding the M audio signals, the side information, the upmix metadata and the downmix metadata.

EEE17. The method according to any one of EEEs 13-16, wherein said decision is based on the number M of audio signals and number CH of channels in the audio output.

EEE18. The method according to EEE 17, wherein step i) is performed when M<CH.

EEE19. A decoder system for rendering an audio output based on an audio data stream, comprising:

a receiver for receiving a data stream including:

M audio signals which are combinations of N audio objects, wherein N>1 and M≤N, side information including a series of reconstruction instances $c_i$ of a reconstruction matrix C and first timing data defining transitions between said instances, said side information allowing reconstruction of the N audio objects from the M audio signals, and time-variable object metadata including a series of metadata instances $m_i$ defining spatial relationships between the N audio objects and second timing data defining transitions between said metadata instances;

a matrix generator for generating a synchronized rendering matrix $R_{sync}$ based on the object metadata, the first timing data, and information relating to a current playback system configuration, said synchronized rendering matrix $R_{sync}$ having a rendering instance $r_i$ for each reconstruction instance $c_i$; and an integrated renderer including:

a matrix combiner for multiplying each reconstruction instance $c_i$ with a corresponding rendering instance $r_i$ to form a corresponding instance of an integrated rendering matrix INT; and a matrix transform for applying the integrated rendering matrix INT to the M audio signals in order to render an audio output.

EEE20. The system according to EEE 19, wherein the matrix transform is configured to use the first timing data to interpolate between instances of the integrated rendering matrix INT.

EEE21. The system according to EEE 19 or 20, wherein the matrix generator is configured to:

resample the object metadata, using said first timing data, to form synchronized metadata, and consequently generate the synchronized rendering matrix $R_{sync}$ based on said synchronized metadata and said information relating to a current playback system configuration.

EEE22. The system according to EEE 21, wherein the matrix generator is configured to select, for each reconstruction instance $c_i$, an appropriate existing metadata instance $m_i$.

EEE23. The system according to EEE 21, wherein the matrix generator is configured to calculate, for each reconstruction instance $c_i$, a corresponding rendering instance by interpolating between existing metadata instances $m_i$.

EEE24. The decoder according to EEE 19 or 20, wherein the matrix generator is configured to:

generate an non-synchronized rendering matrix R based on said object metadata and said information relating to a current playback system configuration, and consequently resample said non-synchronized rendering matrix R, using said first timing data, in order to form the synchronized rendering matrix $R_{sync}$.

EEE25. The system according to EEE 24, wherein the matrix generator is configured to select, for each reconstruction instance $c_i$, an appropriate existing instance of the non-synchronized rendering matrix R.

EEE26. The system according to EEE 24, wherein the matrix generator is configured to calculate, for each reconstruction instance $c_i$, a corresponding rendering instance by interpolating between instances of the non-synchronized rendering matrix R.

EEE27. The system according to any one of EEEs 19-26, wherein said side information further includes a decorrelation matrix P, the decoder further comprising:

a pre-matrix transform for generating a set of K decorrelation input signals by applying a matrix Q to the M audio signals, said matrix Q formed by the decorrelation matrix P and the reconstruction matrix C, a decorrelation stage for decorrelating said K decorrelation input signals to form K decorrelated audio signals;

wherein said matrix combiner is further configured to multiply each instance $p_i$ of the decorrelation matrix P with a corresponding rendering instance $r_i$ to form a corresponding instance of an integrated decorrelation matrix INT2; and wherein said matrix transform is further configured to apply the integrated decorrelation matrix INT2 to the K decorrelated audio signals in order to generate a decorrelation contribution to the rendered audio output.

EEE28. The system according to any one of EEEs 19-27, wherein said first timing data includes, for each reconstruction instance $c_i$, a ramp start time $tc_i$ and a ramp duration $dc_i$, and wherein a transition from a preceding instance $c_{i-1}$ to the instance $c_i$ is a linear ramp with duration $dc_i$ starting at $tc_i$.

EEE29. The system according to any one of EEEs 19-28, wherein said second timing data includes, for each metadata instance $m_i$, a ramp start time $tm_i$ and a ramp duration $dm_i$, and a transition from a preceding instance $m_{i-1}$ to the instance $m_i$ is a linear ramp with duration $dm_i$ starting at $tm_i$.

EEE30. The system according to any one of EEEs 19-29, wherein the data stream is encoded, the system further comprising a decoder for decoding the M audio signals, the side information and the metadata.

EEE31. A decoder system for adaptive rendering of audio signals, comprising:

a receiver for receiving a data stream including:

M audio signals which are combinations of N audio objects, wherein N>1 and M≤N, side information including a series of reconstruction instances $c_i$ allowing reconstruction of the N audio objects from the M audio signals, upmix metadata including a series of metadata instances $m_i$ defining spatial relationships between the N audio objects, and downmix metadata including a series of metadata instances $m_{dmx,i}$ defining spatial relationships between the M audio signals;

a first rendering function configured to provide an audio output based on the M audio signals using said side information, said upmix metadata, and information relating to a current playback system configuration;

a second rendering function configured to provide an audio output based on the M audio signals using said downmix metadata and information relating to a current playback system configuration; and processing logic for selectively activating said first rendering function or said second rendering function.

EEE32. The system according to EEE 31, wherein said first rendering function includes:

a matrix generator for generating a synchronized rendering matrix $R_{sync}$ based on the object metadata, the first timing data, and information relating to a current playback system configuration, said synchronized rendering matrix $R_{sync}$ having a rendering instance $r_i$ for each reconstruction instance $c_i$; and an integrated renderer including:

a matrix combiner for multiplying each reconstruction instance $c_i$ with a corresponding rendering instance $r_i$ to form a corresponding instance of an integrated rendering matrix INT, and a matrix transform for applying the integrated rendering matrix INT to the M audio signals in order to render the audio output.

EEE33. The system according to EEE 31 or 32, wherein the second rendering function includes:

a matrix generator for generating a rendering matrix $R_{core}$ based on the downmix metadata and the information relating to a current playback system, and a matrix transform for applying said rendering matrix $R_{core}$ to the M audio signals to render the audio output.

EEE34. The system according to any one of EEEs 31-33, wherein the data stream is encoded, and the system further comprises a decoder for decoding the M audio signals, the side information, the upmix metadata and the downmix metadata.

EEE35. The system according to any one of EEEs 31-34, wherein said processing logic makes a selection based on the number M of audio signals and number CH of channels in the audio output.

EEE36. The system according to EEE 35, wherein the first rendering function is performed when M<CH.

EEE37. A computer program product comprising computer program code portions which, when executed on a computer processor, enable the computer processor to perform the steps of the method according to one of EEEs 1-18.

EEE38. A non-transitory computer readable medium storing thereon a computer program product according to EEE 37.

The invention claimed is:

1. A method for rendering an audio output based on an audio data stream, comprising:

receiving a data stream including:

M audio signals which are combinations of N audio objects, wherein N>1 and M≤N, side information including a series of reconstruction instances $c_i$ of a reconstruction matrix C and first timing data defining transitions between said instances, said side information allowing reconstruction of the N audio objects from the M audio signals, and time-variable object metadata including a series of metadata instances $m_i$ defining spatial relationships between the N audio objects and second timing data defining transitions between said metadata instances;

generating a synchronized rendering matrix $R_{sync}$ based on the object metadata, the first timing data, and information relating to a current playback system configuration, said synchronized rendering matrix $R_{sync}$ having a rendering instance $r_i$ corresponding in time with each reconstruction instance $c_i$, wherein the generating comprises:

resampling the object metadata, using said first timing data, to form synchronized metadata, and consequently generating the synchronized rendering matrix $R_{sync}$ based on said synchronized metadata and said information relating to a current playback system configuration;

multiplying each reconstruction instance $c_i$ with a corresponding rendering instance $r_i$ to form a corresponding instance of an integrated rendering matrix INT; and applying the integrated rendering matrix INT to the M audio signals in order to render an audio output.

2. The method according to claim 1, wherein the step of applying the integrated rendering matrix INT includes using the first timing data to interpolate between instances of the integrated rendering matrix INT.

3. The method according to claim 1, wherein the resampling includes selecting, for each reconstruction instance $c_i$, an appropriate existing metadata instance $m_i$.

4. The method according to claim 1, wherein the resampling includes calculating, for each reconstruction instance $c_i$, a corresponding rendering instance by interpolating between existing metadata instances $m_i$.

5. The method according to claim 1, wherein the step of generating a synchronized rendering matrix $R_{sync}$ includes:

generating an non-synchronized rendering matrix R based on said object metadata and said information relating to a current playback system configuration, and consequently resampling said non-synchronized rendering matrix R, using said first timing data, in order to form the synchronized rendering matrix $R_{sync}$.

6. The method according to claim 5, wherein the resampling includes selecting, for each reconstruction instance $c_i$, an appropriate existing instance of the non-synchronized rendering matrix R.

7. The method according to claim 5, wherein the resampling includes calculating, for each reconstruction instance $c_i$, a corresponding rendering instance by interpolating between instances of the non-synchronized rendering matrix R.

8. The method according to claim 1, wherein said side information further includes a decorrelation matrix P, the method further comprising:

generating a set of K decorrelation input signals by applying a matrix Q to the M audio signals, said matrix Q computed from the decorrelation matrix P and the reconstruction matrix C, decorrelating said K decorrelation input signals to form K decorrelated audio signals;

multiplying each instance $p_i$ of the decorrelation matrix P with a corresponding rendering instance $r_i$ to form a corresponding instance of an integrated decorrelation matrix INT2; and applying the integrated decorrelation matrix INT2 to the K decorrelated audio signals in order to generate a decorrelation contribution to the rendered audio output.

9. The method according to claim 1, wherein said first timing data includes, for each reconstruction instance $c_i$, a ramp start time $tc_i$ and a ramp duration $dc_i$, and wherein a transition from a preceding instance $c_{i-1}$ to the instance $c_i$ is a linear ramp with duration $dc_i$ starting at $tc_i$.

10. The method according to claim 1, wherein said second timing data includes, for each metadata instance $m_i$, a ramp start time $tm_i$ and a ramp duration $dm_i$, and a transition from a preceding instance $m_{i-1}$ to the instance $m_i$ is a linear ramp with duration $dm_i$ starting at $tm_i$.

11. The method according to claim 1, wherein the data stream is encoded, and the method further comprises decoding the M audio signals, the side information and the metadata.

12. A decoder system for rendering an audio output based on an audio data stream, comprising:

a receiver for receiving a data stream including:

M audio signals which are combinations of N audio objects, wherein N>1 and M≤N, side information including a series of reconstruction instances $c_i$ of a reconstruction matrix C and first timing data defining transitions between said instances, said side information allowing reconstruction of the N audio objects from the M audio signals, and time-variable object metadata including a series of metadata instances m, defining spatial relationships between the N audio objects and second timing data defining transitions between said metadata instances;

a matrix generator for generating a synchronized rendering matrix $R_{sync}$ based on the object metadata, the first timing data, and information relating to a current playback system configuration, said synchronized rendering matrix $R_{sync}$ having a rendering instance $r_i$ corresponding in time with each reconstruction instance $c_i$, wherein the matrix generator is configured to:

resample the object metadata, using said first timing data, to form synchronized metadata, and consequently generate the synchronized rendering matrix $R_{sync}$ based on said synchronized metadata and said information relating to a current playback system configuration; and an integrated renderer including:

a matrix combiner for multiplying each reconstruction instance $c_i$ with a corresponding rendering instance $r_i$ to form a corresponding instance of an integrated rendering matrix INT; and a matrix transform for applying the integrated rendering matrix INT to the M audio signals in order to render an audio output.

13. The decoder system according to claim 12, wherein the matrix transform is configured to use the first timing data to interpolate between instances of the integrated rendering matrix INT.

14. The decoder system according to claim 12, wherein the matrix generator is configured to:

resample the object metadata, using said first timing data, to form synchronized metadata, and consequently generate the synchronized rendering matrix $R_{sync}$ based on said synchronized metadata and said information relating to a current playback system configuration.

* * * * *